US011421436B2

(12) United States Patent
Lisle et al.

(10) Patent No.: US 11,421,436 B2
(45) Date of Patent: Aug. 23, 2022

(54) METHOD OF INSTALLING AND SUPPORTING PORCH POSTS

(71) Applicants: Rob Lisle, Bridgeville, DE (US); Mark Ricker, Ocean View, DE (US)

(72) Inventors: Rob Lisle, Bridgeville, DE (US); Mark Ricker, Ocean View, DE (US)

( * ) Notice: Subject to any disclaimer, the term of this patent is extended or adjusted under 35 U.S.C. 154(b) by 0 days.

(21) Appl. No.: 16/994,727

(22) Filed: Aug. 17, 2020

(65) Prior Publication Data

US 2021/0047848 A1 Feb. 18, 2021

Related U.S. Application Data

(60) Provisional application No. 62/887,093, filed on Aug. 15, 2019.

(51) Int. Cl.

| | |
|---|---|
| ***E04H 12/22*** | (2006.01) |
| ***E04G 17/00*** | (2006.01) |
| ***E04G 13/06*** | (2006.01) |
| ***E04C 3/30*** | (2006.01) |

(52) U.S. Cl.

CPC ..... *E04H 12/2269* (2013.01); *E04C 3/30* (2013.01); *E04G 13/066* (2013.01); *E04G 17/00* (2013.01); *E04H 12/2215* (2013.01); *E04H 12/2238* (2013.01)

(58) Field of Classification Search

CPC . E04H 12/22; E04H 12/2207; E04H 12/2215; E04H 12/2238; E04H 12/2253; E04H 12/2261; E04H 12/2269; E04H 12/2276; E04H 12/2292

USPC .. 52/298, 296, 297, 742.15, 742.14, 745.12, 52/745.21

See application file for complete search history.

(56) References Cited

U.S. PATENT DOCUMENTS

| | | | | | |
|---|---|---|---|---|---|
| 349,240 | A | * | 9/1886 | Thomas | E02D 5/80 52/155 |
| 772,928 | A | * | 10/1904 | Dunlap | E04H 12/2269 52/298 |
| 822,995 | A | * | 6/1906 | Sischo | E04H 12/2269 52/298 |
| 2,545,048 | A | * | 3/1951 | Salmons | E04H 12/22 174/6 |
| 3,166,871 | A | * | 1/1965 | Simison | E04H 12/22 206/321 |
| 3,288,413 | A | * | 11/1966 | Gregory | E04H 12/2238 248/158 |

(Continued)

FOREIGN PATENT DOCUMENTS

| | | | | |
|---|---|---|---|---|
| CH | 565903 | * | 8/1975 | E04H 12/2215 |
| DE | 2648039 | A1 * | 4/1978 | E04H 12/22 |

(Continued)

*Primary Examiner* — Michael Safavi

(74) *Attorney, Agent, or Firm* — Bradley Arant Boult Cummings LLP; Timothy L. Capria

(57) ABSTRACT

A support for installing a porch post comprises a body. The body includes a ground end and a post end opposite of the ground end. A base is disposed on the ground end of the body. Two or more sidewalls extend from the base toward the post end. One or more open cross-members extend between the two or more sidewalls. The ground end may include a ground surface comprising grippers or stanchions extending away from the ground surface for securing the support with the ground.

21 Claims, 6 Drawing Sheets

(56) References Cited

U.S. PATENT DOCUMENTS 4,096,677 A * 6/1978 Gilb ..... E02D 27/42 405/231
4,156,332 A * 5/1979 Thompson ..... E04H 12/2215 52/165
4,199,908 A * 4/1980 Teeters ..... E04H 12/2284 248/357
4,269,010 A * 5/1981 Glass ..... E04H 17/08 52/154
4,378,175 A * 3/1983 Hasselqvist ..... E01F 9/638 404/10
4,644,713 A * 2/1987 Lehman ..... E04H 12/2215 52/165
4,646,489 A * 3/1987 Feller ..... E04H 12/2253 256/DIG. 5
4,724,642 A * 2/1988 Hoffman ..... E02D 27/02 403/170
4,924,648 A * 5/1990 Gilb ..... E04B 1/41 52/295
4,972,642 A * 11/1990 Strobl, Jr. ..... E02D 27/42 52/165
4,995,206 A * 2/1991 Colonias ..... E04H 12/2253 52/298
5,090,656 A * 2/1992 Brown ..... E04H 12/2215 248/530
5,123,623 A * 6/1992 McNamara ..... E04H 12/2253 248/156
5,666,774 A * 9/1997 Commins ..... E04H 12/2253 248/188.4
7,980,034 B2 * 7/2011 Fehr ..... E04C 3/30 52/297
8,240,097 B2 * 8/2012 Day ..... E04C 2/20 52/298
8,584,413 B1 * 11/2013 Keller, Sr. ..... E02D 27/32 52/297
8,959,857 B1 * 2/2015 Lin ..... E04H 12/2261 52/296
9,540,840 B2 * 1/2017 Ma ..... E04H 12/2269
10,501,957 B1 * 12/2019 Borowiak ..... E04H 12/2269
2002/0066247 A1 * 6/2002 Leek ..... E04B 1/2604 52/295
2002/0152695 A1 * 10/2002 Gilsdorf ..... E02D 27/42 52/98
2003/0159381 A1 * 8/2003 Meyer ..... E04C 3/36 52/299
2006/0201087 A1 * 9/2006 Cutforth ..... E02D 27/16 52/296
2009/0094931 A1 * 4/2009 Sanders ..... E04B 1/41 52/698
2009/0293393 A1 * 12/2009 Masters ..... E02D 27/50 52/295
2012/0085050 A1 * 4/2012 Greenwood ..... E04B 1/41 52/296
2017/0335590 A1 * 11/2017 Volin ..... E04H 12/2215

FOREIGN PATENT DOCUMENTS

FR 509246 A * 11/1920 ..... E04H 12/2269
FR 2140875 A5 * 1/1973 ..... E04H 12/22
GB 2244500 A * 12/1991 ..... E04H 12/2284
JP 55032872 A * 3/1980
KR 101707170 B1 * 2/2017 ..... E04H 12/2261
WO WO-2020201506 A1 * 10/2020 ..... E04B 1/41

* cited by examiner

METHOD OF INSTALLING AND SUPPORTING PORCH POSTS

CROSS-REFERENCE TO RELATED APPLICATION

This application claims the benefit of U.S. Provisional Patent Application No. 62/887,093, filed Aug. 15, 2019, which is incorporated by reference herein in its entirety.

FIELD OF THE DISCLOSURE

This disclosure relates generally to structural supports. In particular, this disclosure relates to supports for both temporarily and permanently supporting a porch post during and after the construction of a structure, such as a residential home.

BACKGROUND

In the US, there are over 700,000 new housing starts each year. Many of these homes include an overhang or porch. Typically, these porches require supports, often for both aesthetic and structural purposes for holding up the porch roof. Such posts can be, for example, clad in a decorative façade or take the form of more traditional columns. Currently, the installation of porch posts is not efficient. Indeed, a porch roof is constructed first, and then, and temporary beams (typically one or more lumber two-by-fours) are angled between the ground and the porch roof to act as temporary structural support for the load of the porch roof. These temporary beams are angled such that they do not contact the ground in the area that the porch floor is to be poured, as in most instances porch floors are constructed of poured concrete or cement. Such an arrangement is shown in FIG. 6 (prior art).

With these temporary beams, permanent posts must be installed and secured on the porch floor to support the porch roof after the concrete or cement of the floor has sufficiently cured. After the permanent posts are installed, the temporary beams can be removed. This process is inefficient and costly, as often workers on housing start sites perform specialized tasks such that framers frame the home, including installing the temporary beams, while different workers pour the concrete floor, and still other workers install permanent posts and other finishing work, thereby necessitating a further trip by the framers to remove the temporary beams. Moreover, these temporary beams are often discarded as waste.

What is needed, then, is a support that eliminates the need for a temporary beam and provides greater structural support to the porch roof while reducing wasted worker time, trips, and materials during construction.

BRIEF SUMMARY

In one aspect, a support for installing porch post is disclosed. The support comprises a body including a ground end and a post end opposite of the ground end. The support comprises a base disposed on the ground end. The base may have a rectangular or square profile. The base may comprise a ground surface including one or more grippers.

The support comprises two or more sidewalls extending from the base toward the post end. The two or more sidewalls may comprise a pair of sidewalls disposed oppositely around the base. The support may comprise one or more open sides disposed between the pair of sidewalls. The two or more sidewalls may each comprise one or more apertures. The support comprises one or more open cross-members extending between the two or more sidewalls. The one or more open cross-members may each comprise at least one hole.

The base may extend along a base plane, and the one or more cross-members may each extend along a cross-member plane, and the base plane may be disposed orthogonally with the cross-member plane. The intersection of the base and the one or more cross-members may define a chamber. The support may be integrally formed and/or constructed from steel or a polymer.

In a second aspect, a support for installing a porch post is disclosed. The support comprises a body including a ground end and a post end opposite of the ground end. The support comprises a base including a ground surface disposed on the ground end of the body. The support comprises two or more sidewalls extending from the base toward the post end. The two or more sidewalls may comprise a pair of sidewalls disposed oppositely around the base. One or more open sides may be disposed between the pair of sidewalls. The two or more sidewalls may each comprise one or more apertures. The support comprises one or more stanchions extending away from the ground surface of the base.

In a third aspect, a method of setting a porch post is disclosed. The method includes providing a porch post support that includes a body comprising a ground end and a post end opposite of the ground end, a base disposed on the ground end of the body, two or more sidewalls extending from the base toward the post end, and one or more open cross-members extending between the two or more sidewalls. The support may include a ground surface having one or more grippers. The method includes positioning the porch post support under a porch roof. The method includes disposing a post within the two or more sidewalls. The method includes securing the post with the two or more sidewalls. The method includes pouring cement or concrete at least over the one or more open cross-members. The two or more sidewalls may each comprise at least one aperture, and the securing of the post may be by fastening the two or more sidewalls with the post with a fastener through the at least one aperture. The method may comprise securing the support with a ground with the one or more grippers. The method may comprise disposing the cement or concrete between the open cross-members. The method may comprise securing the porch roof with the secured post.

DETAILED DESCRIPTION

Figure 1:
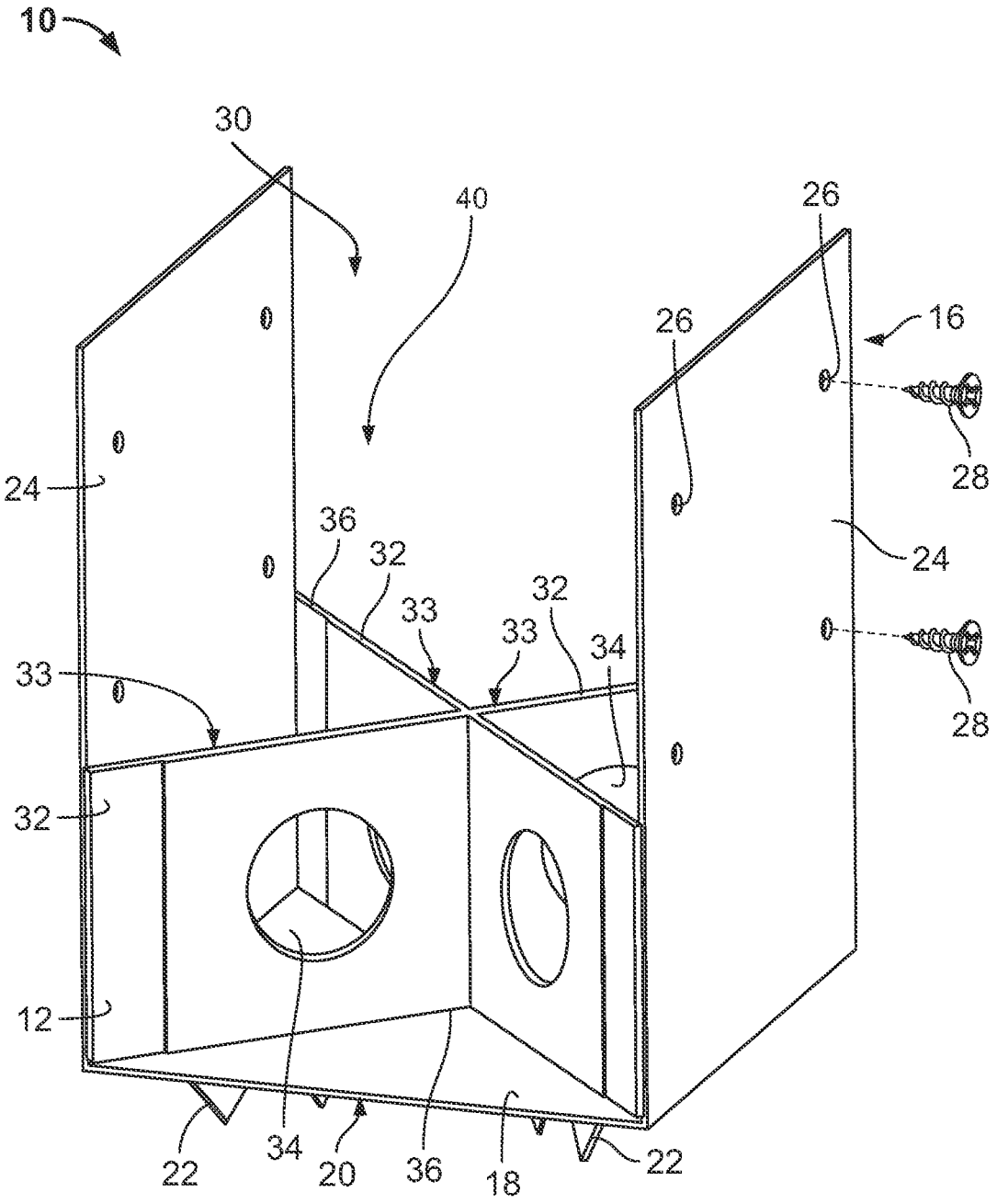
FIG. 1 shows a front perspective view of a support according to an embodiment.

The embodiments set forth below represent the necessary information to enable those skilled in the art to practice the disclosure and illustrate the best mode of practicing the disclosure. Upon reading the following description in light of the accompanying drawings, those skilled in the art will understand the concepts of the disclosure and will recognize applications of these concepts not particularly addressed herein. It should be understood that these concepts and applications fall within the scope of the disclosure and the accompanying claims.

The supports and methods disclosed herein enable the quick, safe, and efficient installation of porch posts. While the instant disclosure references "porch," the term "porch" is interchangeable with, and means, any structural overhang.

Referring now to FIGS. 1-5, a support 10 for receiving and installing a porch post is disclosed. The support 10 may be integrally formed, rigid, and constructed of any suitable material, such as metal (e.g., steel or aluminum) or a polymer such as acrylic, composites, polycarbonate, polyethylene, polypropylene, polyvinyl chloride, and the like. In embodiments where the support 10 is constructed of metal, the support 10 may be treated so as to prevent or reduce rust, such as galvanized or treated with a rust inhibitor. The support 10 includes a body 12 comprising a ground end 14 and a post end 16 opposite of the ground end 14. Generally, the ground end 14 is the portion of the support 10 that is proximate to the ground when the support 10 is installed, and the post end is the portion of the support 10 that receives the post, opposite of ground end 14, when the support 10 is installed with the post.

The support 10 includes a base 18 disposed on the ground end 14 of the body 12. The base 18 may have a rectangular or square profile. The base 18 may comprise a ground surface 20. The ground surface 20 may include one or more grippers 22 for gripping, or securing, the support 10 with the ground. The one or more grippers 22 may be in the form of teeth. Advantageously, when the support 10 is positioned on the ground, the grippers 22 grip the ground to prevent lateral movement of the support 10, and thereby the post, when the post is receiving and installed with support 10. Such a feature is especially advantageous, as it is envisioned that the support 10 and the installed post will often be installed to support a porch roof without any additional structural support to the roof, as explained further below.

Figure 2:
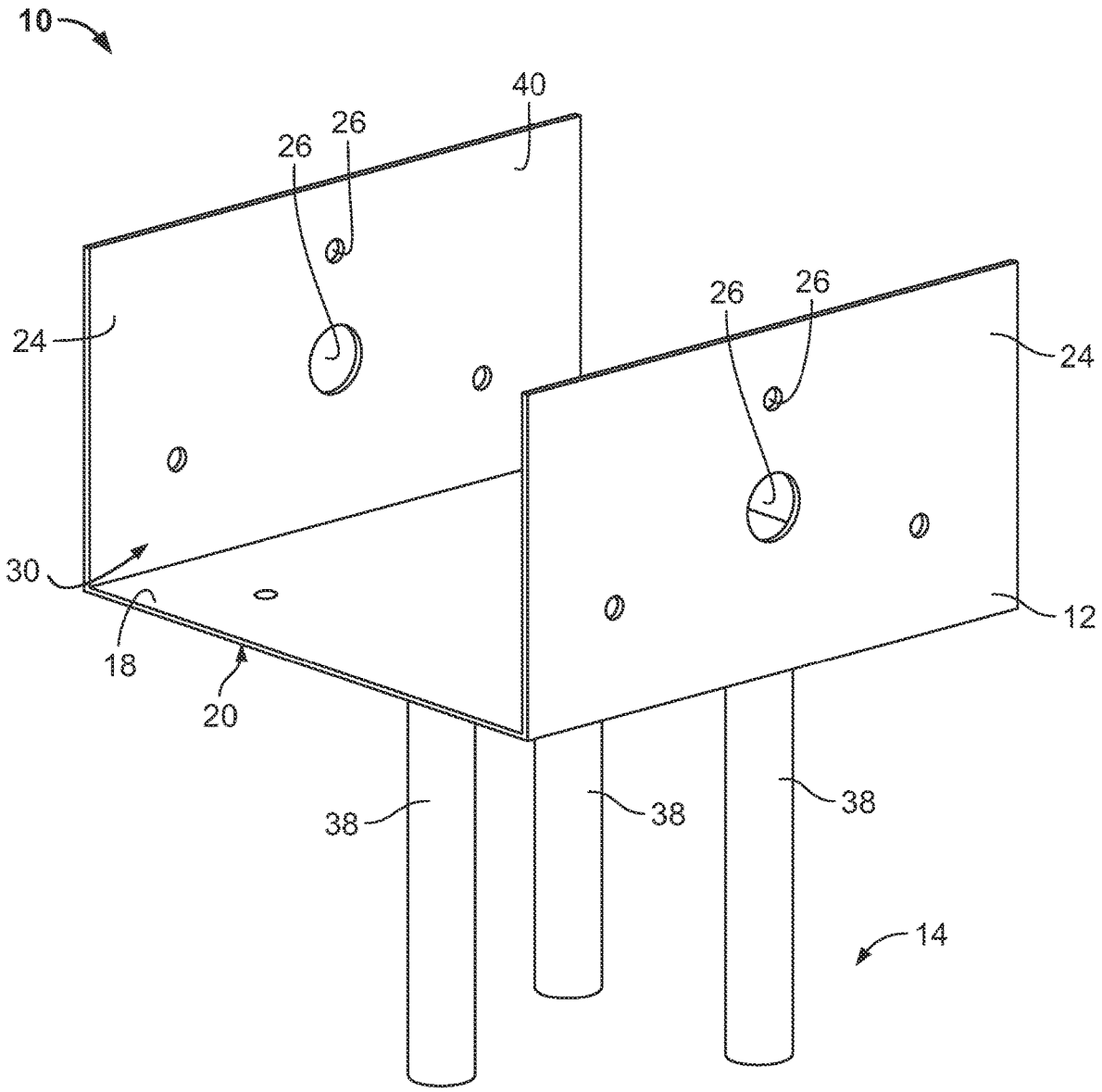
FIG. 2 shows a front perspective view of a support according to another embodiment.
Figure 3A:
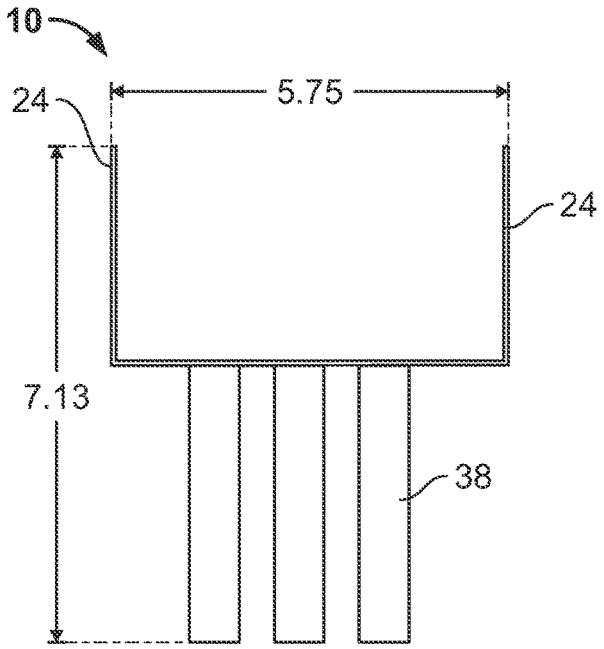
FIG. 3A shows a front elevation view of the support of FIG. 2.
Figure 3B:
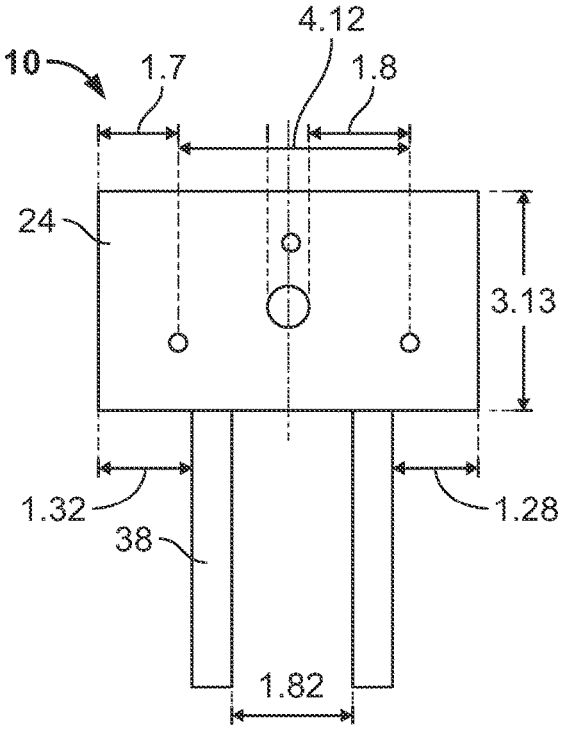
FIG. 3B shows a side view of the support of FIG. 2.
Figure 3C:
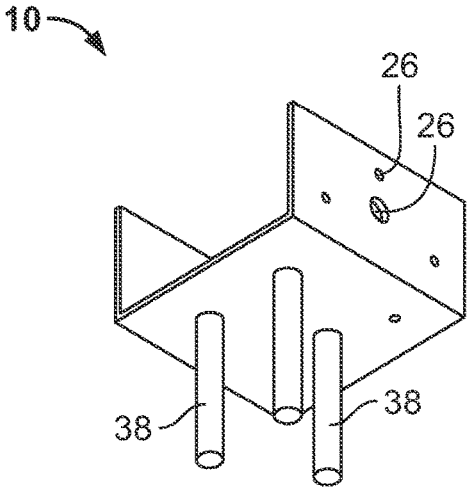
FIG. 3C shows a bottom perspective view of the support of FIG. 2.
Figure 3D:
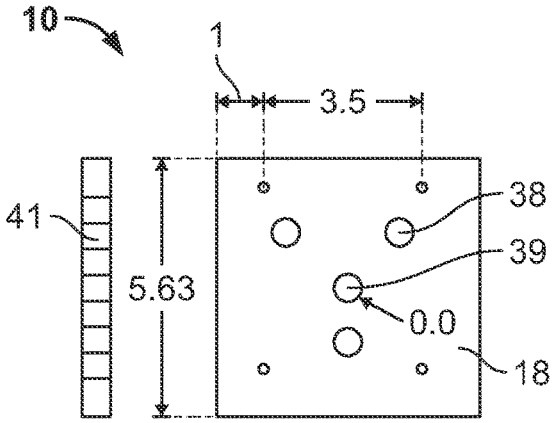
FIG. 3D shows a bottom view of the support of FIG. 2.
Figure 4:
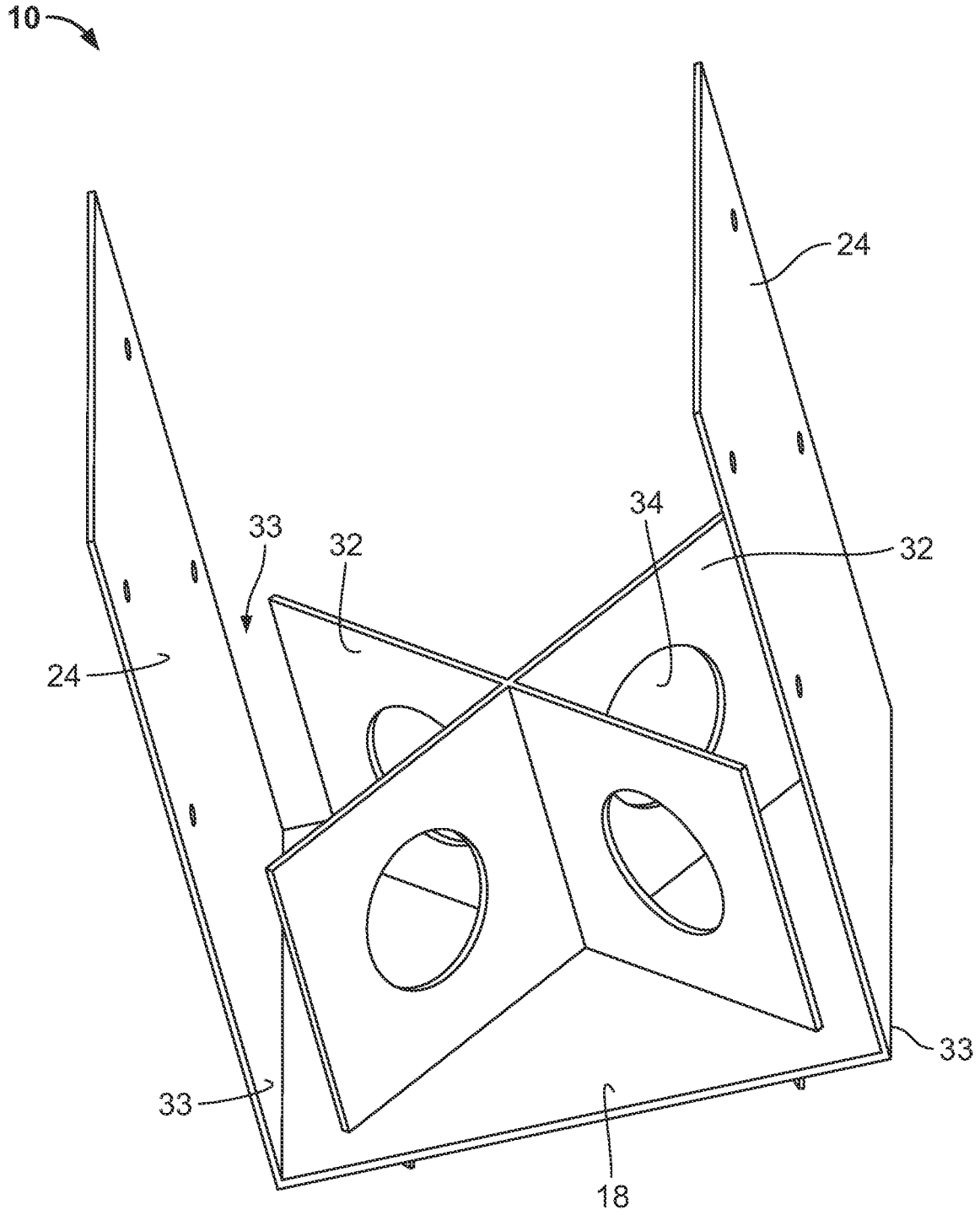
FIG. 4 shows a front elevation view of a support according to yet another embodiment.

The support 10 comprises one or more sidewalls 24 extending from the base 18 toward the post end 16. The sidewalls 24 may be of a sufficient height to secure the post from movement when fastened with the support 10. The sidewalls 24 may be substantially planar and each define a sidewall plane. The sidewalls 24 may be disposed around the base 18. In some embodiments, a pair of sidewalls 24 may be disposed oppositely around the base 18. The sidewalls 24 may each include one or more apertures 26 for fastening the post with the support 10 with a fastener 28, such as a nail, bolt, screw, or the like. The size (e.g., diameter) of the apertures 26 may be varied in accordance with the side of the respective fastener 28 to be used, as shown in FIGS. 2-3D. The support 10 may comprise one or more open sides 30 disposed between the sidewalls 24. The open sides 30 and/or the sidewalls 24 may define a cavity 40 that is dimensioned and shaped to cooperatively receive the post (such as a treated wooden four-by-four or similar materials).

As shown in FIGS. 1 and 4-5D, the support 10 may comprise one or more open cross-members 32 extending between the sidewalls 24. In some embodiments, the cross-members 32 may extend directly from one sidewall 24 to another sidewall 24, such as opposite sidewalls, as shown in FIG. 1. In other embodiments, the cross-members 32 may be spaced a distance from the sidewall(s) by a gap 33. The open cross-members 32 may each comprise at least one hole 34. The hole(s) 34 may be of any shape. When the post is positioned within, and installed with, the support 10, the post may rest on a top edge 33 of the cross-members 32. The base 18 may extend along and define a base plane, and the cross-members 32 may each extend along and define a cross-member plane, and the base plane may be disposed orthogonally to the cross-member plane. Beneficially, this orientation enables the support 10 to be structurally strong even when holes 34 are present in the cross-members 32.

The intersection of the base 18 and the cross-members 32 may define one or more chambers 36. After the post is positioned within the support 10 and secured with the support 10 (such as with apertures 26 and fasteners 28), concrete or cement may be poured around the support 10 and/or the post. Beneficially, the holes 34 enable the concrete or cement to flow between the chambers 36, thereby securing the support 10 with the structure. This feature is highly advantageous, as typically porch roofs are built before porch floors are poured. While conventional systems use temporary beams that must later be removed, this feature allows the support 10 and the post to serve as a permanent support for the porch roof, even before the porch floor is poured. After the porch floor is poured, the structural strength of the support and post assembly is further enhanced, especially by the passage of the cement or concrete around the chambers 36 via the holes 34. The gap 33 feature may further enhance the flow of concrete or cement around the chambers 36.

In another aspect of the support 10 as shown in FIGS. 2-3D, the support 10 may not include the cross-members 32 and may comprise one or more stanchions 38. The stanchions 38 may have any shape profile, such as circular, as shown in FIGS. 2-3D. The stanchions 38 may be partially pushed within the ground and the post secured with the support 10 such that the stanchions 38 are partially out of the ground to be covered by the pouring of the porch floor with concrete or cement. Referring to FIG. 3D, the base may include a base hole 39 for a fastener 41, such as a bolt and nut, a screw, a nail, rebar, or any other suitable fastener, to secure the support 10 with the ground (including a concrete slab).

Figure 5A:
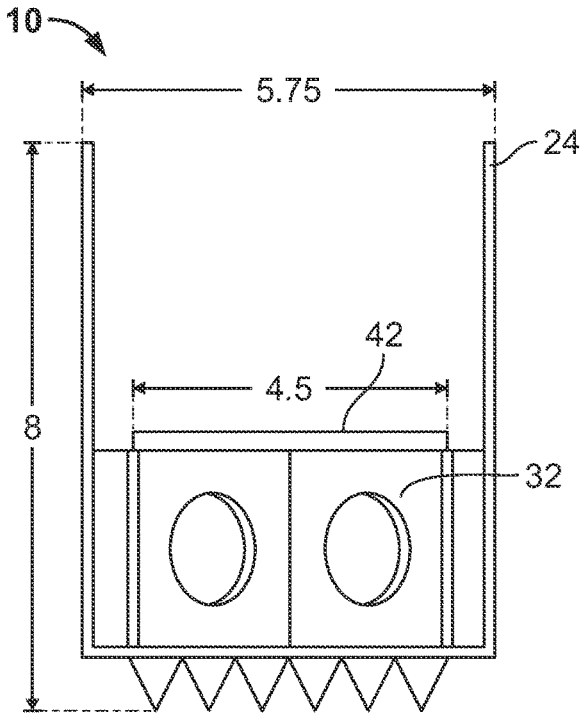
FIG. 5A shows a front elevation view of the support of FIG. 4.
Figure 5B:
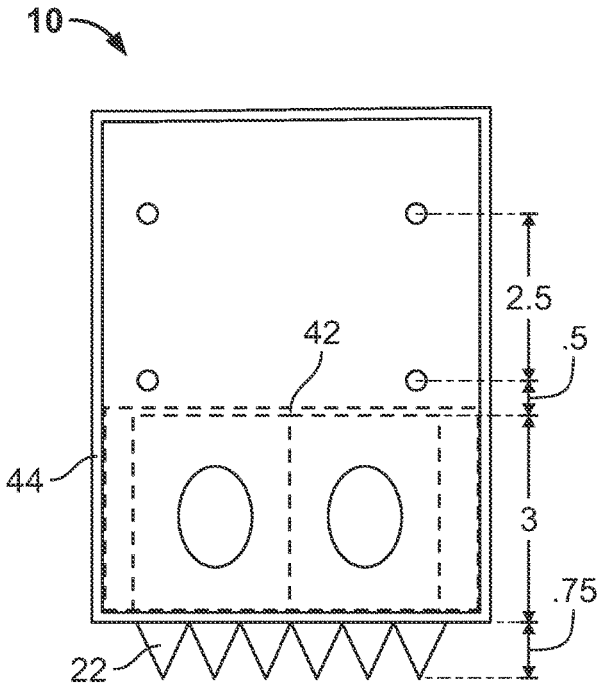
FIG. 5B shows a side view of the support of FIG. 4.
Figure 5C:
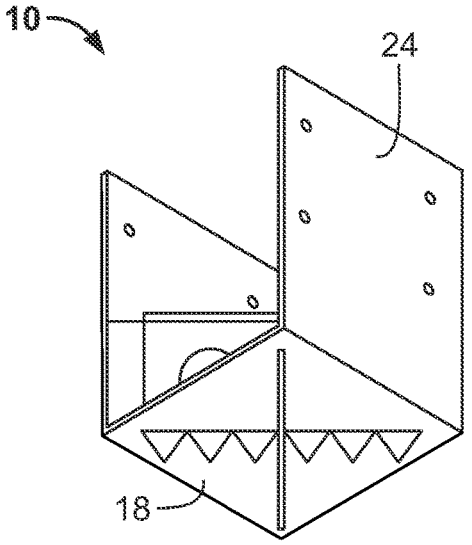
FIG. 5C shows a bottom cutaway perspective view of the support of FIG. 4.
Figure 5D:
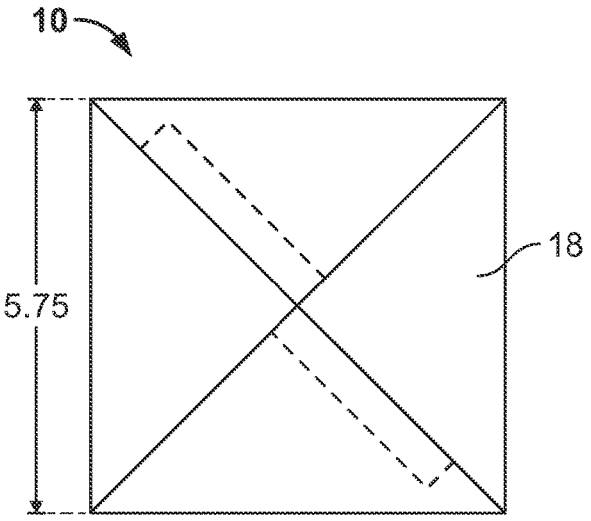
FIG. 5D shows a bottom view of the support of FIG. 4.
Figure 6:
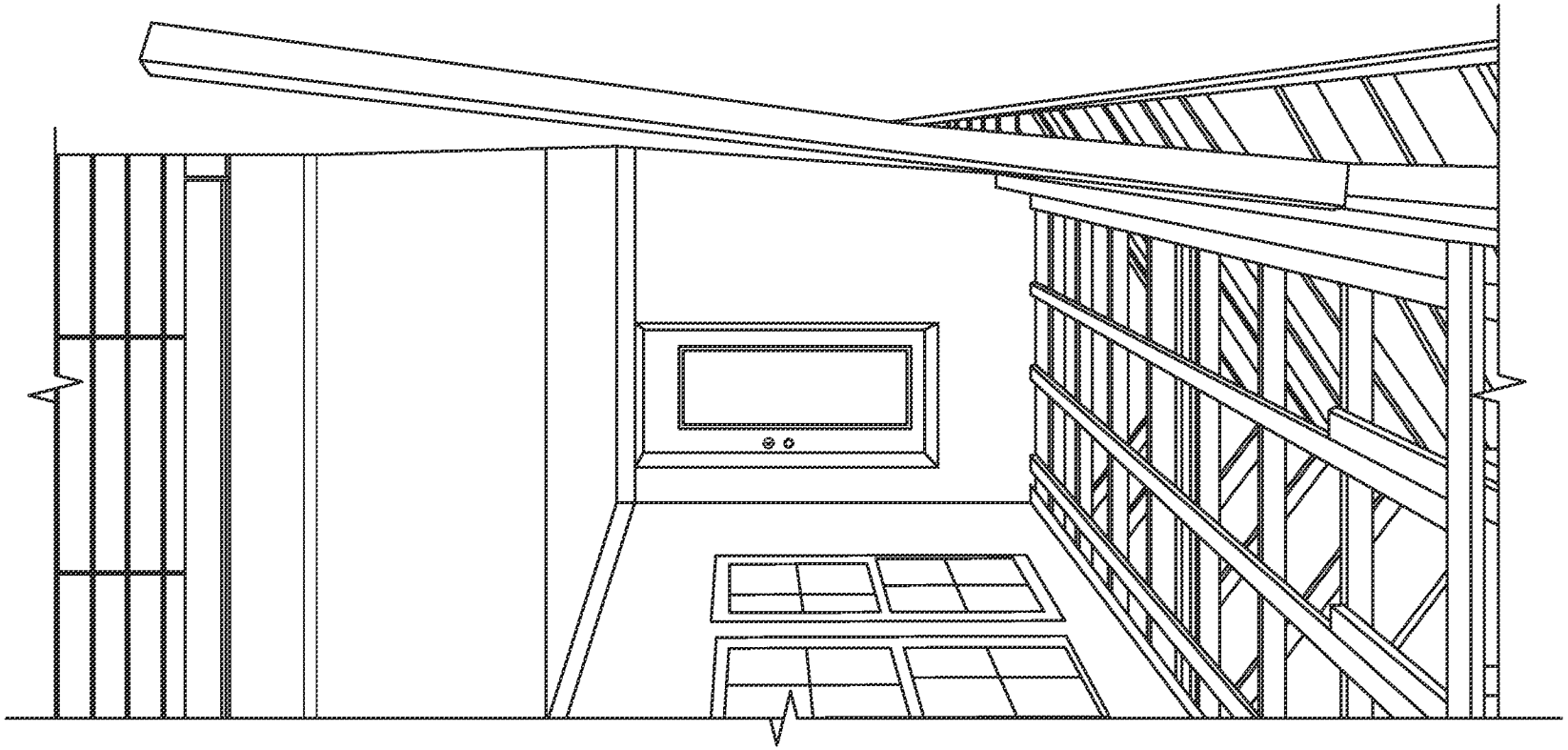
FIG. 6 (Prior Art)
FIG. 6 shows a prior art support.

In a further aspect of the support 10, as shown in FIGS. 5A-5D, the support 10 is foldable. In particular, the cross-members 32 are pivotable and foldable such that the support 10 may be more easily transported and stored, as multiple supports 10 may be stacked cooperatively one another. Cross-members 32 may pivot around a central axis 42 such that the cross-members can be pivoted into the cross-member plane. The cross-members 32 may include a hinge 44 with one of the sidewalls 24 (as shown in FIG. 5B) or base 18 (not shown) such that the cross-members 28 may hingedly fold against one of the sidewalls 24 or the base 18, such as after pivoting together. Thus, the cross-members 32 may first be pivoted together around central axis 42 (FIG. 5D) and subsequently folded around the hinge 44 into a folded position (FIG. 5C) and unfolded around the hinge 44 to stand upright and pivoted around the central axis 42 into an unfolded position (FIG. 5A).

In yet another aspect of the disclosure, a method of using the support 10 to secure, or set, the post is disclosed. The method includes providing the support 10, positioning the support 10 under a porch roof, disposing the post within the sidewalls 24, securing the post with the sidewalls 24, and pouring cement over at least part of the support 10 and/or the post, such as the cross-members 32 or the stanchions 38. The securing of the post may be by fastening the sidewalls 24 with the post via a fastener 28 through the aperture(s) 26. The method may include securing the support 10 with the ground with the grippers 22. The method may comprise disposing, or pouring, cement or concrete between the open cross-members 32 or the stanchions 38. The porch roof may be secured with, or fastened to, the secured post (including in instances where concrete has been, or has not been, poured).

Those skilled in the art will recognize improvements and modifications to the preferred embodiments of the present disclosure. All such improvements and modifications are considered within the scope of the concepts disclosed herein and the claims that follow.

What is claimed is:

1. A method of setting a porch post, comprising:
providing a porch post support including
a body comprising a ground end and a post end opposite of the ground end,
a base disposed on the ground end of the body,
two or more sidewalls extending from the base toward the post end, and
one or more open cross-members extending between the two or more sidewalls;
positioning the porch post support under a porch roof;
disposing a post within the two or more sidewalls;
securing the post with the two or more sidewalls; and
pouring cement or concrete at least over the one or more open cross-members.

2. The method of claim 1, wherein the two or more sidewalls each comprise at least one aperture, and wherein the securing of the post is by fastening the two or more sidewalls with the post with a fastener through the apertures in the two or more sidewalls.

3. The method of claim 1, wherein the support includes a ground surface having one or more grippers.

4. The method of claim 3, further comprising securing the support with a ground with the one or more grippers.

5. The method of claim 1, further comprising disposing the cement or concrete between the open cross-members.

6. The method of claim 1, further comprising securing the porch roof with the secured post.

7. The method of claim 1, wherein the two or more sidewalls comprise a pair of sidewalls disposed oppositely around the base.

8. The method of claim 7, wherein the support comprises one or more open sides disposed between the pair of sidewalls.

9. The method of claim 1, wherein the two or more sidewalls each comprise one or more apertures.

10. The method of claim 1, wherein the one or more open cross-members comprise at least one hole.

11. The method of claim 1, wherein the base extends along a base plane, and wherein the one or more open cross-members each extend along a cross-member plane, and the base plane is disposed orthogonally with the cross-member plane.

12. The method of claim 1, wherein the intersection of the base and the one or more open cross-members defines a chamber.

13. The method of claim 1, wherein the base has a rectangular or square profile.

14. The method of claim 1, wherein the support is integrally formed.

15. The method of claim 1, wherein the support is constructed of steel or a polymer.

16. A method of setting a porch post, comprising:
providing a porch post support including
a body comprising a ground end and a post end opposite of the ground end,
a base disposed on the ground end of the body,
two or more sidewalls extending from the base toward the post end, and
one or more open cross-members extending between the two or more sidewalls;
positioning the porch post support under a porch roof;
disposing a post within the two or more sidewalls and directly above the one or more open cross-members;
securing the post with the two or more sidewalls; and
pouring cement or concrete at least over the one or more open cross-members.

17. The method of claim 16, further comprising disposing the cement or concrete between the open cross-members.

18. The method of claim 16, wherein the one or more open cross-members comprise at least one hole.

19. The method of claim 16, wherein the base extends along a base plane, and wherein the one or more open cross-members each extend along a cross-member plane, and the base plane is disposed orthogonally with the cross-member plane.

20. The method of claim 19, wherein the intersection of the base and the one or more open cross-members defines a chamber.

21. The method of claim 16, wherein the base has a rectangular or square profile.

* * * * *